United States Patent [19]

Kanno et al.

[11] Patent Number: 4,708,669

[45] Date of Patent: Nov. 24, 1987

[54] WARNING DEVICE FOR A WATERCRAFT PROVIDED WITH A PLURALITY OF MARINE PROPULSION ENGINES

[75] Inventors: Isao Kanno; Yasuo Yamamoto, both of Hamamatsu, Japan

[73] Assignee: Sanshin Kogyo Kabushiki Kaisha, Hamamatsu, Japan

[21] Appl. No.: 869,134

[22] Filed: May 30, 1986

[30] Foreign Application Priority Data

Jun. 1, 1985 [JP] Japan ..... 60-119521

[51] Int. Cl.[4] ..... B63B 22/00

[52] U.S. Cl. ..... 440/1

[58] Field of Search ..... 440/1, 2, 49, 84, 79; 244/76 A; 60/698, 705, 706; 340/606, 608

[56] References Cited

U.S. PATENT DOCUMENTS 4,598,278 7/1986 Ford ..... 440/2

FOREIGN PATENT DOCUMENTS 214494 12/1983 Japan ..... 440/1

*Primary Examiner*—Jeffrey V. Nase
*Assistant Examiner*—Jesés D. Sotelo
*Attorney, Agent, or Firm*—Ernest A. Beutler

[57] ABSTRACT

A marine propulsion device having a pair of outboard motors each of which has a sensing device for sensing an abnormal running condition, a warning device for indicating a warning of the abnormal running condition and a control device for slowing the speed of the engine in response to the sensed abnormal running condition. An arrangement is provided wherein the sensing of an abnormal running condition of either engine is effective to slow the speed of both engines and provide the abnormal running condition indication for both engines. The normal engine may be reset to full speed control in response to shifting of the normal running engine either into a neutral condition or by slowing or stopping of it.

45 Claims, 3 Drawing Figures

WARNING DEVICE FOR A WATERCRAFT PROVIDED WITH A PLURALITY OF MARINE PROPULSION ENGINES

BACKGROUND OF THE INVENTION

This invention relates to a warning device for a watercraft provided with a plurality of marine propulsion engines and more particularly to an improved warning device for providing more stable running in the event of a detrimental condition existent in one of the engines.

It is well known in larger and more powerful watercrafts to provide, as a propulsion device, a plurality of outboard motors mounted on the transom of the watercraft for propelling it. It is also well known that individual outboard motors may include devices for protecting the outboard motor against damage and for warning the operator of a dangerous operating condition. Such devices may sense either a low oil level or a high operating temperature and provide a warning signal to the operator if these conditions occur. In addition, such systems frequently employ an arrangement for retarding or slowing the speed of the outboard motor under such a dangerous condition. However, when a watercraft is powered by two outboard motors so equipped and a dangerous condition exists in one of the outboard motors, the operation of the watercraft may become unstable and, furthermore, the slowing of the outboard motor having the dangerous condition can be overridden. That is, if the watercraft is powered by a pair of outboard motors and one of them slows abruptly due to a dangerous condition, the stability and direction of travel of the watercraft may be serious affected and require operator control in order to return a watercraft to the desired direction of travel. Also, when one of the outboard motors is slowed and the other continues to operate at full speed, the watercraft speed will be maintained at a relatively high level and the water will drive the propeller of the slowed engine and cause its speed to increase again and thus the protection of the engine is offset and damage might occur.

It is, therefore, a principal object of this invention to provide an improved warning device for a watercraft provided with a plurality of marine propulsion engines.

It is a further object of this invention to provide an improved arrangement for insuring the stability of operation of a dual powered watercraft in the event a dangerous condition exists in one of the powering devices which requires slowing of it for its protection.

It is a further object of this invention to provide an improved warning device that insures protection of one of the powering engines of a watercraft in the event of a dangerous condition that requires its slowing.

SUMMARY OF THE INVENTION

This invention is adapted to be embodied in a warning system for a marine propulsion that comprises a first engine driving a first propulsion means and a second engine driving a second propulsion means. First sensing means is provided for sensing an abnormal running condition of the first engine and a first warning means is operated by the first sensing means for providing a warning signal to the operator when the first sensing means senses an abnormal running condition of the first engine. A second sensing means is provided for sensing an abnormal running condition of the second engine and second warning means are operated by the second sensing means for providing a warning signal to an operator when the second sensing means senses an abnormal running condition of the second engine. In accordance with the invention, means are provided for actuating both the first and second warning means upon the sensing of an abnormal running condition of either engine by either of the sensing means.

Another feature of the invention is adapted to be embodied in a protection system for a marine propulsion that comprises a first engine driving a first propulsion means and a second engine driving a second propulsion means. First sensing means are provided for sensing an abnormal running condition of the first engine and first protection means are provided for slowing the speed of the first engine upon the sensing of an abnormal running condition by the first sensing means. A second sensing means is provided for sensing an abnormal running condition of the second engine and second protection means are provided for slowing the speed of the second engine in response to the sensing of an abnormal running condition by the second sensing means. In accordance with this feature of the invention, both of the protection means are activated for slowing both of the engines upon the sensing of an abnormal running condition of either engine by either of the sensing means.

DETAILED DESCRIPTION OF THE PREFERRED EMBODIMENT

Figure 1:
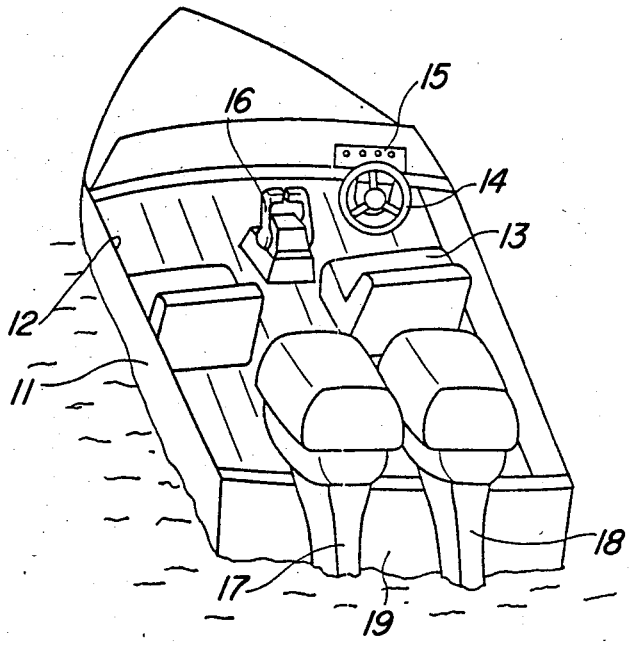
FIG. 1 is a persepctive view of a watercraft powered by a pair of outboard motors and embodying a warning device constructed in accordance with an embodiment of the invention.

Referring first to FIG. 1, a watercraft that is adapted to employ a powering system embodying the invention is identified generally by the reference numeral 11. The watercraft 11 is comprised of a hull that defines a passenger compartment 12 in which a pair of seats including an operator's seat 13 are positioned. A steering wheel 14 and dashboard 15 are positioned to the front of the operator's seat 13. In addition, a combined throttle and transmission control mechanism 16 is positioned adjacent the operator's seat 13.

A pair of outboard motors 17 and 18 are mounted on a transom 19 of the hull 11 for powering the watercraft. The outboard motors 17 and 18 are controlled by the dual handles of the control mechanism 16 in a known manner.

Each of the outboard motors 17 and 18 is provided with a warning and protective system for providing a warning signal in the event of an abnormal running condition and for protecting the engine in the event of such an abnormal condition. These systems are shown schematically by the block diagrams in FIG. 2 and, in accordance with the invention, an interrelationship is provided between the individual systems so that if either engine experiences an abnormal running condition, both engine warnings will be activated and the speed of both engines will be controlled for the reasons as aforenoted.

Figure 2:
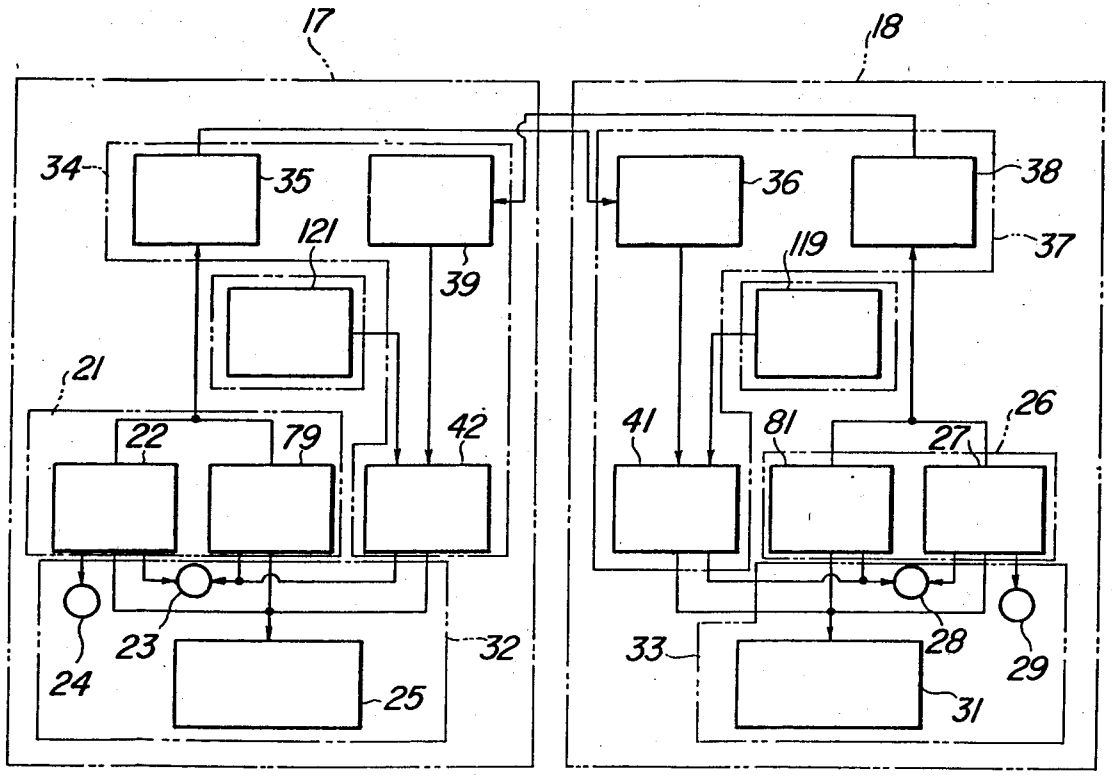
FIG. 2 is a schematic block diagram showing the operation of the warning means.

Referring now specifically to FIG. 2, the sensing means of the outboard motor 17 is indicated generally by the block 21 and includes an abnormal running condition sensor such as a lubricant level sensor 22. In the event the lubricant level sensor 22 senses a low or dangerous level of lubricant, it will operate a warning buzzer 23 and simultaneously a warning light 24. The warning buzzer 23 is positioned at or in proximity to the dash panel 15 and the warning light 24 is positioned directly on the instrument panel 15. Thus, the operator seated in the seat 13 will immediately receive a signal of an abnormal running condition of the outboard motor 17.

In addition, the lubricant sensor 22 outputs a signal of warning condition to an engine speed slowing circuit 25 which operates to automatically reduce the speed of the outboard motor 17 so as to protect it from the abnormal running condition.

In a similar manner, the outboard motor 18 includes an abnormal running condition sensor 26 that includes an abnormal running condition sensing device 27, which also is responsive to the sensing of an abnormal running condition such as a low oil level. When the sensor 27 indicates a low oil level, it will activate a buzzer 28 and also a warning light 29 so as to give the operator an indication of an abnormal running condition. Furthermore, an engine speed slowing circuit 31 will be energized so as to slow the running speed of the engine 18.

The warning and protection system of the engine 17 is indicated by the block 32 while the warning and protective system of the engine 18 is indicated by the block 33. The warning systems 32 and 33 are interrelated so that the activation of the warning system of either engine will result in the activation of the warning system of the other system. If, for example, the warning system 21 and specifically the abnormal running condition warning sensor 22 outputs a warning signal, this warning signal is transferred by a control means, indicated by the block 34 and including a transfer circuit 35, to a warning signal receiving circuit 36 of the outboard motor 18. In a similar manner, the sensing circuit 26 and specifically the abnormal running condition sensor 27 sends a signal through a control means 37 including a warning signal transfer circuit 38 to a receiving circuit 39 of the outboard motor 17.

The receiving circuit 36 of the outboard motor 18 outputs a signal to a holding circuit 41 which, in turn, activates the speed controlling circuit 31 of the outboard motor 18 so as to effect a reduction in its speed and also sound the warning buzzer 28. In a similar manner, the receiving circuit 39 of the outboard motor 17 transfers its signal to a holding circuit 42 that will activate the speed reducing circuit 25 of this motor so as to reduce its speed and illuminates the warning light 22.

It should be readily apparent that the disclosed system insures that the operator will be adequately warned in response to the abnormal running condition of either of the outboard motors 17 and 18 and further that both of the outboard motors 17 and 18 will be slowed in the event of an abnormal running condition of either of them. Hence, a sudden directional change of the watercraft 11 will be averted and it will be insured that the engine experiencing the abnormal running condition will not be overspeeded due to the driving thrust of the engine running under the normal condition.

An arrangement is provided for permitting the normal running engine to be operated at its maximum speed under operator control, even if the abnormal running engine does not have its abnormal situation corrected. However, it is also important to insure that correction of the condition of the abnormal running engine does not cause immediate resumption of the preset speed for the normal running engine because this could upset the occupants of the watercraft. Thus, in order to return the normal running engine to full operator control and regardless of whether or not the abnormal running engine has its situation corrected, certain things must be done by the operator in order to return the normal engine to full control. Protection may be accomplished by either requiring the operator to shift the normal running engine to its neutral condition or to manually close the throttle of the normal running engine to its idle condition. It also would be possible to return the normal running engine to its full operator control by first shutting off the normal running engine, however, as will be noted, this is not as desirable as the other two methods. If any one of the aforenoted conditions are met (shifting to neutral, closing the throttle valve or stopping the normal running engine), the holding circuit of the normal running (41 or 42) is deactivated so that that engine can return to its normal running speed. In a like manner, if the abnormal running engine is stopped and filled with lubricant, both engines can return to their normal running speed since the holding circuits 41 and 42 will be de-energized, as will become apparent.

It is important that the system does not make it necessary to shut off the normal running engine under the abnormal condition of the other engine because this could prove to be dangerous. That is, it might be difficult to restart the normal running engine. Also, it is to be understood that the holding circuits 41 and 42 may be de-energized in other methods than by moving the transmission of the normal running engine to its neutral condition. As has been noted, this can be done by stopping of the normal running engine or by moving its throttle valve to a closed position and the methods of doing this should be readily apparent to those skilled in the art.

Figure 3:
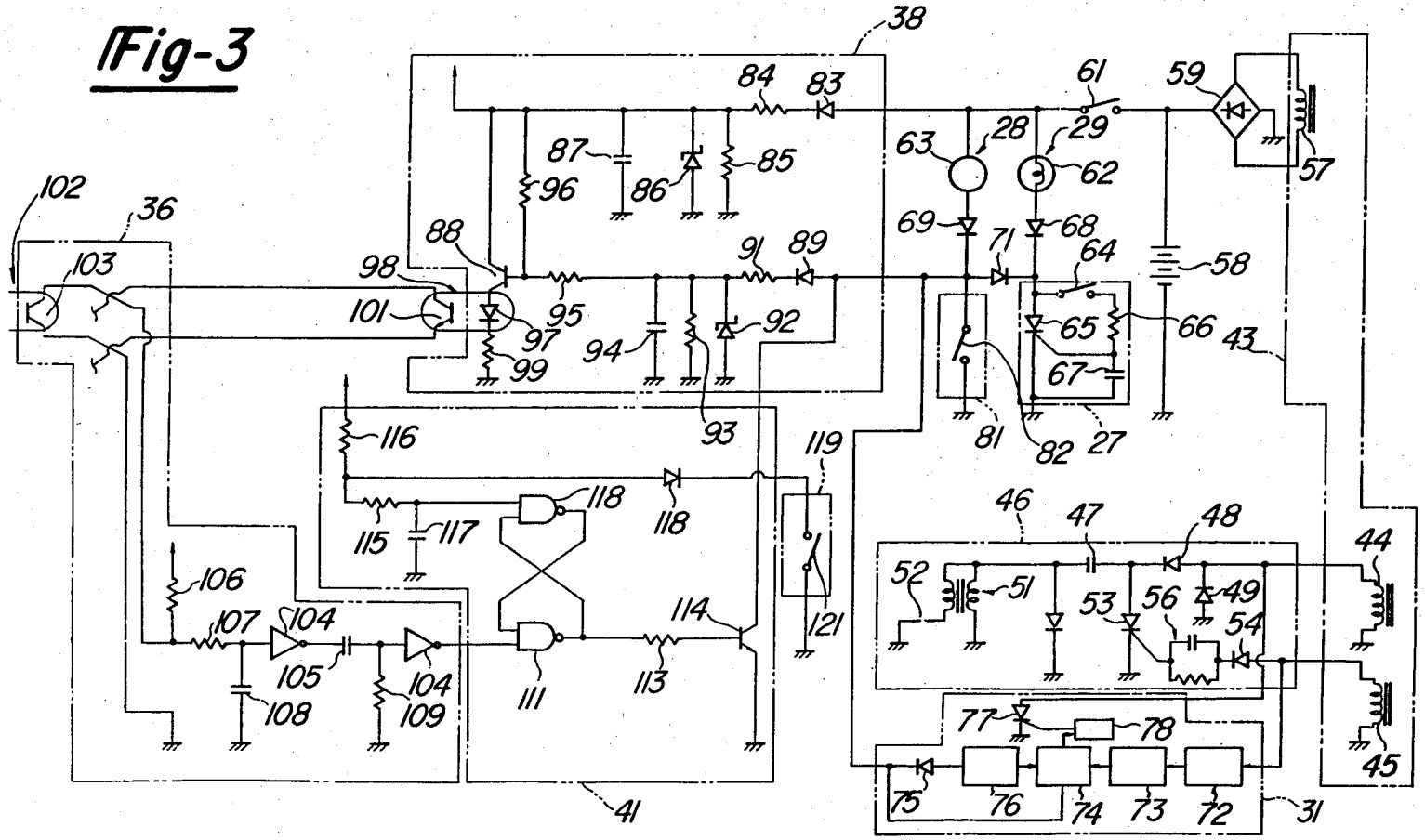
FIG. 3 is a schematic electrical diagram of the warning device.

Referring now in detail to FIG. 3, the actual electrical circuit for the device is illustrated in conjunction with the outboard motor 18 and shows its relationship to the output signals which are sent to the holding circuit 42 of the outboard motor 17 and for receiving the signals from the transfer circuit 35 of the outboard motor 17.

Referring now in detail to FIG. 3, a magneto generator is indicated generally by the reference numeral 43 and is associated, in a known manner, with the flywheel of the engine of the outboard motor 18. This magneto generator 43 includes a charging coil 44 and a pulser coil 45 that provides their charges and signals to a capacitor discharge ignition circuit, represented by the block 46 and having the circuit illustrated therein.

The capacitor discharge ignition circuit 46 includes a charging capacitor 47 that is charged by the charging coil 44 through a rectifying diode 48. A further diode 49, that conducts current in the opposite direction, is interposed in parallel relationship between the diode 48 and the charging coil 44. The diode 49 is connected between the ground and the charging coil 44 so as to provide a circuit during the half wave of operation when the capacitor 47 is not being charged.

The capacitor 47 is charged during one-half wave of the operation of the charging coil 44 and is discharged at an appropriate time, by means of a triggering circuit, to be described, so as to cause a discharge through a primary winding of an ignition coil 51 so as to induce a voltage in the second coil that causes a spark plug 52 to be fired. It is to be understood that although only a single cylinder and spark plug is depicted, the system can readily be applied to multi-cylinder engines by those skilled in the art.

The triggering circuit for the charging capacitor 47 includes a SCR 53 that is in circuit between the diode 48 and charging capacitor 47 and the ground. The voltage of the gate of the SCR 53 is controlled by the pulser coil 45 which, in turn, has a current induced in it at the appropriate time of crankshaft angle by means of a trigger magnet (not shown). The voltage through a diode 54 and capacitor resistor circuit 56 renders the gate of the SCR 53 conductive so that the charging capacitor 47 will be discharged and the spark plug 52 fired.

The magneto generator 43 also includes a generating coil 57 that charges a battery 58 through a rectifier diode bridge 59. A main ignition switch 61 connects the battery 58 with a plurality of circuits including parallel circuits containing the warning light 29, indicated by the bulb 62 and the warning buzzer 28 indicated by the circle 63.

The warning control circuit 27 includes a switch 64 having a normally open contact and which may be activated by a lubricant level sensor, for example, that shown in U.S. Pat. No. 4,562,801, entitled "Engine Control System For Marine Propulsion Device" issued Jan. 7, 1986 in the name of Takashi Koike, and assigned to the assignee of this application. When the switch 64 closes, the gate of an SCR 65 will be rendered conductive through a circuit comprised of a resistor 66 and capacitor 67 so as to complete the circuit from the battery 58 through the warning bulb 66 and a diode 68. At the same time, the circuit through the buzzer 63, which includes diodes 69 and 71, will be completed so that the buzzer will be sounded.

The closing of the switch 64 to indicate a low lubricant level also activates the circuit 31 for providing a speed reduction of the engine 18 to protect it. This speed reduction mechanism operates as shown in the embodiment of FIG. 2 of U.S. Pat. No. 4,562,801 and reference may be had to that patent for the details of the manner of speed reduction. Generally, however, the speed reducing circuit 31 includes a waveform shaping circuit 72 that receives signals from the pulser coil 45. The circuit 72 generates a square waveform pulse from these signals and transmits them to a frequency to voltage converter 73 which outputs a voltage signal indicative of engine speed to an oscillator circuit 74.

The low lubricant level signal transmitted by the closure of the switch 64 also is transmitted through a diode 75 to a delay circuit 76. The delay circuit 76 has a voltage output that is delivered to the oscillator circuit 74. The delay circuit 76 operates like a capacitor in that its output signal decays along a curve.

The oscillator circuit 74 has its output voltage generated for a time period which is varied in accordance with the difference between the voltages from the frequency to voltage converter 73 and that from the delay circuit 76. This output voltage acts on a shunting circuit for shunting the output of the charging coil 44 to the ground through an SCR 77. The SCR 77 is rendered conductive by means of a gate circuit 78 controlled by the oscillator 74 so as to periodically disable the ignition of the engine and reduce its speed. This circuit is, as has been noted, described in more detail in U.S. Pat. No. 4,562,801 and reference may be had to that patent for the description of the logic and operation of the speed reducing circuit.

In addition to providing a slowing of the speed of the engine of the outboard motor 18 in response to a low lubricant level, a further sensor may be provided for slowing the speed in response to another sensed condition and such sensors for the outboard motors 17 and 18 are indicated by the blocks 79 and 81 in FIG. 2. These blocks may represent sensor such as engine temperature sensors which have normally opened switches 82 (FIG. 3) which are in circuit with the buzzer 28 and complete a circuit to ground when this abnormal condition is sensed. This also completes the circuit to the delay circuit 75 to cause misfiring and engine slowing under this condition.

As has been noted, the indication of a abnormal condition and engine slowing transmits a signal to the warning signal transferring circuit 38 for activating the warning signal receiving circuit 39 of the outboard motor 17. This activating signal is generated by the circuit as now will be described in FIG. 3. This circuit includes a stable voltage supply circuit that consists of a diode 83 and resistor 84 which are in series with the master switch 61 and battery 58. A resistor 85, zener diode 86 and capacitor 87 are disposed in grounded relationship with this circuit so as to provide a filtering function and insure a stable voltage supply. This stable voltage supply is transmitted to a transistor 88 which is switched by a circuit now to be described.

This switching circuit includes a diode 89 and resistor 91 that are in circuit with the junction between the diode 69 and the diode 71 so as to complete this circuit in the event of an abnormal condition indication. These signals are stabilized by a zener diode 92, resistor 93 and capacitor 94 that are appropriately grounded. A pair of resistors 95 and 96 are connected to the base of the transistor 88 and the transistor 88 will become rendered conductive when the abnormal condition signal has been transmitted.

This causes illumination of a light emitting diode LED 97 of an optical isolator 98 through a grounded circuit including a resistor 99. Illumination of the LED 97 will switch a transistor 101 so as to cause a current to flow through the lines which lead to the warning receiving signal 39 of the outboard motor 17 so as to activate its holding circuit 42 so as to effect the warning indication and also so as to slow the speed of the engine of the outboard motor 17. This receiving and holding circuit is the same as the corresponding circuits 36 and 41 of the outboard motor 18 and these circuits may be understood by reference to FIG. 3.

Receiving circuit 36 of the outboard motor 18 includes an optical isolator 102 which is similar to the optical isolator 98 and which includes an LED (not shown) which triggers a transistor 103 so as to transmit a signal to a signal processing circuit that includes a pair of inverters 104 and 104 that are in series with a capacitor 105 positioned between them. A pull up resistor 107 is in this series circuit as is a further resistor 106. A grounded capacitor 108 is interposed between the first inverter 104 and the ground and a resistor 109 is grounded between the other inverter 104 and capacitor 105.

The output of the receiver circuit 36 is transmitted to the holding circuit 41 including a flip-flop comprised of a pair of appropriately wired NAND gates 111 and 12. The NAND gate 111 is in circuit through a resistor 113 with the base of a transistor 114. The transistor 114 has its state changed so that the abnormal condition signal is transmitted to the diode 75 of the circuit 31 so as effect a speed reduction through the circuit 31 and sounding of the buzzer 63.

The flip-flop circuit also includes a pair of resistors 115 and 116 and a capacitor 117. A diode 118 is positioned in a reset line that extends to a reset device 119 which may include a switch 121 that is responsive to shifting of the outboard motor to its neutral condition so as to reset the flip-flop and disengage the holding circuit so that the outboard motor 18 may again be returned to its normal running speed. Alternatively, the switch 121 may be operative in response to other conditions, as aforenoted.

It should be noted that a similar reset switch 121 is provided for the outboard motor 17 for permitting its holding circuit to be disabled when the abnormal condition exists in the outboard motor 18 and the motor 17 has been moved to its neutral position or has otherwise been stabilized.

It should be readily apparent from the foregoing description that an improved and simplified arrangement is provided wherein both outboard motors of a twin outboard motor drive are slowed in response to an abnormal condition of either one of the outboard motors. This insures against the likelihood of an abrupt change in direction. In addition, it insures that the motor experiencing the abnormal condition will not be oversped due to having its engine being turned by the rotation of the propeller in the water. Furthermore, a simple arrangement is provided for permitting resetting of the speed of the normal condition motor once that motor has been shifted into a neutral condition or slowed or stopped. In addition, when the abnormal condition is removed such as by stopping of the engine and refilling the lubricant, the outboard motors may both be then operated at their full speed.

Although an embodiment of the invention has been illustrated and certain modifications have been described, it is to be understood that various changes and modifications may be made without departing from the spirit and scope of the invention, as defined by the appended claims.

We claim:

1. In a warning system for a marine propulsion comprising a first engine driving a first propulsion means, a second engine driving a second propulsion means, first sensing means for sensing an abnormal running condition of said first engine, first warning means operated by said first sensing means for providing a warning signal to an operator when said first sensing means senses an abnormal running condition of said first engine, second sensing means for sensing an abnormal running condition of said second engine, second warning means operated by said second sensing means for providing a warning signal to an operator when said second sensing means senses an abnormal running condition of said second engine, the improvement comprising means for actuating both said first warning means and said second warning means upon the sensing of an abnormal running condition of either of said engines by either of said sensing means.

2. In a warning system as set forth in claim 1 wherein the abnormal sensed condition is a low lubricant level.

3. In a warning system as set forth in claim 2 further including third and fourth sensing means for activating respectively the first and second warning means upon the sensing of a further abnormal condition, said further abnormal condition being an overheating condition of the respective engine.

4. In a warning system as set forth in claim 1 further including additional sensing means for operating each of the warning means.

5. In a warning system as set forth in claim 4 wherein at least one of the sensing means senses lubricant level.

6. In a warning system as set forth in claim 4 wherein at least one of the sensing means senses an over temperature condition.

7. In a warning system as set forth in claim 1 wherein each of the warning means further includes speed reducing means for slowing the speed of the respective engine in response to the sensed abnormal running condition and both of the speed reducing means are activated upon the sensing of an abnormal running condition by either of the sensing means.

8. In a warning system as set forth in claim 7 further including means for disabling the means for slowing the speed of the engine not experiencing the abnormal running condition in response to operator control.

9. In a warning system as set forth in claim 8 wherein each of the propulsion means includes a transmission and the disabling means is responsive to the shifting of a transmission into neutral.

10. In a warning system as set forth in claim 9 wherein the disabling means is responsive to shifting of the transmission of the normal running engine into neutral.

11. In a warning system as set forth in claim 8 wherein the disabling means is responsive to stopping of the engine not experiencing the abnormal running condition.

12. In a warning system as set forth in claim 11 wherein the disabling means is responsive to stopping of the normally running engine.

13. In a warning system as set forth in claim 8 wherein the operator control is an operator control of the normal running engine.

14. In a warning system as set forth in claim 8 wherein the disabling means is responsive to operator controlled speed reduction of one of the engines.

15. In a warning system as set forth in claim 14 wherein the speed reduction is of the normally running engine.

16. In a warning system as set forth in claim 7 further including holding means for holding the speed of the normally running engine at the reduced speed after the abnormal running condition of the abnormally running engine is cured.

17. In a warning system as set forth in claim 16 further including means for disabling the means for slowing the speed of the engine not experiencing the abnormal running condition in response to operator control.

18. In a warning system as set forth in claim 17 wherein the operator control is an operator control of the normal running engine.

19. In a warning system as set forth in claim 18 wherein propulsion means each include a transmission and the disabling means is responsive to the shifting of a transmission into neutral.

20. In a warning system as set forth in claim 18 wherein the disabling means is responsive to stopping of the normal running engine.

21. In a warning system as set forth in claim 18 wherein the disabling means is responsive to operator controlled speed reduction of the normal running engine.

22. In a warning system as set forth in claim 7 wherein both the warning means and the means for slowing the speed of the respective engine are electrically operated.

23. In a warning system as set forth in claim 22 wherein each of the engines is provided with a separate electrical power supply.

24. In a warning system as set forth in claim 23 wherein the power supply of each engine comprises an engine driven generator and a battery charged by the generator.

25. In a warning system as set forth in claim 24 wherein the signals are transmitted from the sensing means of each engine to the other engine but no electrical power is transmitted from one engine to the other engine.

26. In a warning system as set forth in claim 25 wherein the signals are transmitted between the electrical circuits of the respective engines by means of an optical isolator.

27. In a warning system as set forth in claim 1 wherein the first and second warning means are electrically operated.

28. In a warning system as set forth in claim 27 wherein each of the engines is provided with a separate electrical power supply.

29. In a warning system as set forth in claim 28 wherein the power supply of each engine comprises an engine driven generator and a battery charged by the generator.

30. In a warning system as set forth in claim 28 wherein the signals are transmitted from the sensing means of each engine to the other engine but no electrical power is transmitted from one engine to the other engine.

31. In a warning system as set forth in claim 30 wherein the signals are transmitted between the electrical circuits of the respective engines by means of an optical isolator.

32. In a protective system for a marine propulsion comprising a first engine driving a first propulsion means, a second engine driving a second propulsion means, first sensing means for sensing an abnormal running condition of said first engine, first control means operated by said first sensing means for slowing the speed of said first engine in response to the sensing of an abnormal running condition by said first sensing means, second sensing means for sensing an abnormal running condition of said second engine and second control means operated by said second sensing means for slowing the speed of said second engine in response to the sensing of an abnormal running condition by said second sensing means, the improvement comprising actuating means for actuating said first control means and said second control means for slowing the speed of both of said engines upon the sensing of an abnormal running condition of either of said engines by either of said sensing means.

33. In a protective system as set forth in claim 32 further including means for disabling the means for slowing the speed of the engine not experiencing the abnormal running condition in response to operator control.

34. In a protective system as set forth in claim 33 wherein each of the propulsion means includes a transmission and the disabling means is responsive to the shifting of a transmission into neutral.

35. In a warning system as set forth in claim 34 wherein the operator control is an operator control of the normal running engine.

36. In a protective system as set forth in claim 33 wherein the disabling means is responsive to stopping of an engine not experiencing the abnormal running conditions.

37. In a warning system as set forth in claim 36 wherein the operator control is an operator control of the normal running engine.

38. In a warning system as set forth in claim 33 wherein the operator control is an operator control of the normal running engine.

39. In a warning system as set forth in claim 33 wherein the disabling means is responsive to operator controlled speed reduction of the normal running engine.

40. In a warning system as set forth in claim 32 further including holding means for holding the speed of the normally running engine at the reduced speed after the abnormal running condition of the abnormally running engine is cured.

41. In a warning system as set forth in claim 32 wherein the means for slowing the speed of the engines is electrically operated.

42. In a warning system as set forth in claim 41 wherein each of the engines is provided with a separate electrical power supply.

43. In a warning system as set forth in claim 42 wherein the power supply of each engine comprises an engine driven generator and a battery charged by the generator.

44. In a warning system as set forth in claim 43 wherein the signals are transmitted from the sensing means of each engine to the other engine but no electrical power is transmitted from one engine to the other engine.

45. In a warning system as set forth in claim 44 wherein the signals are transmitted between the electrical circuits of the respective engines by means of an optical isolator.

* * * * *